US005500660A

United States Patent [19]

Childers et al.

[11] Patent Number: 5,500,660

[45] Date of Patent: Mar. 19, 1996

[54] WIPER FOR INKJET PRINTHEAD NOZZLE MEMBER

[75] Inventors: Winthrop D. Childers, San Diego, Calif.; Ronald S. Gompertz, Vancouver, Wash.

[73] Assignee: Hewlett-Packard Company, Palo Alto, Calif.

[21] Appl. No.: 82,198

[22] Filed: Jun. 24, 1993

[51] Int. Cl.[6] ..... B41J 2/165

[52] U.S. Cl. ..... 347/33

[58] Field of Search ..... 346/140 R; 347/33; B41J 2/165

[56] References Cited

U.S. PATENT DOCUMENTS

| | | | |
|---|---|---|---|
| 4,364,065 | 12/1982 | Yamamori et al. | 347/33 X |
| 4,853,717 | 8/1989 | Harmon et al. | 347/29 |
| 5,097,276 | 3/1992 | Midorikawa | 347/33 |
| 5,103,244 | 4/1992 | Gast et al. | 347/33 |
| 5,115,250 | 5/1992 | Harmon et al. | 347/33 |
| 5,278,584 | 1/1994 | Keefe et al. | 347/47 |

FOREIGN PATENT DOCUMENTS

| | | | |
|---|---|---|---|
| 0395004A2 | 10/1990 | European Pat. Off. | B41J 2/165 |
| 446885 | 9/1991 | European Pat. Off. | B41J 2/165 |
| 0525988A2 | 2/1993 | European Pat. Off. | B41J 2/165 |
| 4000454A1 | 7/1991 | Germany | B41J 2/165 |
| 60-206658 | 10/1985 | Japan . | |
| 62-101447 | 5/1987 | Japan | B41J 2/165 |
| 62-101448 | 5/1987 | Japan | B41J 2/165 |
| 5-104734 | 4/1993 | Japan | B41J 2/165 |

*Primary Examiner*—Benjamin R. Fuller
*Assistant Examiner*—Alrick Bobb

[57] ABSTRACT

A wiper according to the invention comprises two or more wiper blades arranged one behind the other in close proximity, where the two or more wiper blades are different from one another so as to have slightly different wiping swaths. The resulting wipers greatly increase the allowable alignment tolerance between the wiper and the nozzle member of a printhead, especially if the printhead is of the kind having raised adhesive beads dispensed near the ends of the nozzle member. In one embodiment, two different size wiper blades, arranged one behind the other, have slits formed near the ends of the wiper blades. The slits mechanically decouple those end portions of the wiper blades which ride over the adhesive beads from the remaining portions of the wiper blades to keep the remaining portions of the blades in contact with the nozzle member.

7 Claims, 4 Drawing Sheets

WIPER FOR INKJET PRINTHEAD NOZZLE MEMBER

CROSS-REFERENCE TO RELATED APPLICATIONS

This application is related to and incorporates by reference the following patents and patent applications, all assigned to the same assignee as the present application:

1. Co-pending U.S. patent application Ser. No. 07/949,197, entitled "Ink-Jet Printhead Capping and Wiping Method and Apparatus," by William S. Osborne, filed Sep. 21, 1992;
2. Co-pending U.S. patent application Ser. No. 08/056,327, entitled "Service Station for InkJet Printer Having Reduced Noise, Increased Ease of Assembly and Variable Wiping Capability," Attorney Docket No. 10931291, by Heinz H. Waschhauser and William S. Osborne, filed Apr. 30, 1993;
3. Co-pending U.S. patent application Ser. No. 08/055,616, entitled "Service Station for InkJet Printer Having Improved Wiping," by Heinz H. Waschhauser and Michael H. Green, filed Apr. 30, 1993;
4. U.S. Pat. No. 4,853,717, entitled "Service Station for Ink-Jet Printer," issued Aug. 1, 1989, to J. Paul Harmon et al.;
5. U.S. Pat. No. 5,115,250, entitled "Wiper For InkJet Printhead," issued May 19, 1992, to J. P. Harmon et al.; and
6. U.S. Pat. No. 5,103,244, entitled "Method and Apparatus for Cleaning Ink-Jet Printheads," issued Apr. 7, 1992, to Paul D. Gast et al.

BACKGROUND OF THE INVENTION

1. Field of the Invention

The present invention relates generally to inkjet printers and, in particular, to a method and structure for wiping the printheads of one or more print cartridges.

2. Description of Related Art

Inkjet printhead nozzles must occasionally be cleaned to remove ink residue or particulates from the nozzles; otherwise the nozzles would become clogged. Conventional service mechanisms in prior art inkjet printers typically provide wiping and capping of printheads to keep the nozzles from becoming clogged.

FIG. 1 illustrates one type of print cartridge 10 having a printhead which requires wiping after a printing session to avoid ink clogging the nozzles. Inkjet print cartridge 10 includes an ink reservoir 12 and a printhead 14, where printhead 14 includes a metal or plastic nozzle plate 16 having formed in it two parallel columns of offset nozzles 17. Nozzle plate 16 is affixed to the surface of a semiconductor substrate (not shown) having heater resistors and vaporization chambers formed on its surface which are aligned with each of the nozzles 17 formed in nozzle plate 16.

A flexible polymer tape 18 has conductive traces formed thereon which terminate in contact pads 20 for contacting corresponding electrodes on a printer when print cartridge 10 is installed in the printer. The conductive traces on tape 18 lead to a rectangular opening in tape 18 in which the nozzle plate 16 is located. The ends of the traces are bonded to exposed electrodes on the rectangular substrate underlying nozzle plate 16. After bonding the traces to the electrodes on the substrate, the electrodes and traces are exposed through the rectangular opening in tape 18 and must be protected from ink and physical damage. To provide such protection, adhesive beads 22 and 23 are dispensed over the exposed traces to encapsulate the traces. The adhesive may be epoxy or any other suitable adhesive.

In another embodiment of a print cartridge which may benefit from the present invention, a nozzle member is created by forming nozzles directly in tape 18 so no separate nozzle plate exists. Openings at both ends of the nozzle array still must be formed in tape 18 to allow the attachment of the conductive traces to electrodes on a substrate affixed to the back of tape 18. The adhesive beads 22 and 23 would still be required to encapsulate the traces.

FIG. 2*a* illustrates print cartridge 10, along with similar print cartridges 25, 26, and 27, installed in a slidable carriage 30 within an inkjet printer.

The snout portion 32 of print cartridge 10 in FIG. 1 is shown protruding through carriage 30 in FIG. 2*a* to be proximate to paper sheet 34.

Carriage 30 is moved along stationary rod 36 in the direction shown by arrow 38. A roller 40 shifts the position of paper sheet 34 as needed. In an actual embodiment, at least two spaced rollers are used to cause paper sheet 34 to be flat along where print cartridges 10 and 25–27 are scanned for printing.

In order to wipe nozzle plate 16 (FIG. 1) clean after a printing session, carriage 30 is automatically moved along rod 36 to a service station area 42. As carriage 30 is shifted into position into service station 42, a series of flexible rubber wipers 44 are raised into their wiping positions so that, as a print cartridge is moved past its associated wiper 44, a wiper 44 presses against the nozzle plate 16 of the associated print cartridge to wipe off residual ink.

Once carriage 30 has been fully shifted into service station 42, the printheads are capped to prevent the drying of ink and to prevent air bubbles from forming in the printhead. The capping function of an inkjet printer and the mechanisms used to raise wipers 44 into position to wipe the nozzle plates of the print cartridges are described in the co-pending applications and patents identified in the Cross-Reference to Related Applications.

Each of wipers 44 consists of a rubber, plastic, composite, or otherwise flexible single wiper blade. With certain types of print cartridges and printheads, the wipers 44 shown in FIG. 2*a* may be satisfactory for wiping a nozzle plate. However, for print cartridges similiar to the print cartridge 10 of FIG. 1, the raised adhesive beads 22 and 23 lift up an end of a wiper 44, as shown in FIG. 2*b*, if the wiper 44 is not properly aligned with respect to nozzle plate 16.

FIG. 2*b* is taken along line A—A in FIG. 1 to illustrate the effect of adhesive beads 22 and 23 on wiper 44 if wiper 44 is not properly aligned with respect to nozzle plate 16. Adhesive beads 22 and 23 may be approximately 1 mm wide and rise approximately 0.25 mm above nozzle plate 16.

FIG. 2*b* also illustrates semiconductor substrate 48 and illustrates conductive traces 50 on a back surface of tape 18 being bonded to electrodes 52 formed on substrate 48. A barrier layer 54 formed on substrate 48 defines vaporization chambers, where each vaporization chamber underlies a nozzle 17.

Adhesive beads 22 and 23 are shown encapsulating conductive traces 50 bonded to electrodes 52 on substrate 48.

If wiper 44 is misaligned slightly to the left of nozzle plate 16, as shown in FIG. 2*b*, bead 22 lifts up the end of wiper 44, leaving an unwiped portion of nozzle plate 16. If the end nozzles 17 are close enough to bead 22, then the lifting up of the end of wiper 44 will cause the end nozzles 17 to not be wiped.

To illustrate the required alignment tolerance of wiper 44, if beads 22 and 23 are located approximately 0.5 mm away from an end nozzle 17, then wiper 44 must be aligned within approximately 0.25 mm with respect to nozzle plate 16 to ensure the end nozzles 17 are correctly wiped. However, the practical consistent alignment of wiper 44 with respect to nozzle plate 16 is approximately ±0.5 mm. The molding tolerance alone for wiper 44 is ±0.2 mm. Hence, using the conventional wiper 44 to wipe nozzle plate 16 on print cartridge 10 in FIG. 1 will not work given the above alignment constraints.

What is needed is a new wiper design which can accommodate typical misalignments between a wiper and a nozzle plate without adversely affecting the wiping of the nozzle plate.

SUMMARY OF THE INVENTION

A wiper according to the invention comprises two or more wiper blades arranged one behind the other in close proximity where the two or more wiper blades are either offset or different from one another so as to have slightly different wiping effects. The resulting wipers greatly increase the allowable alignment tolerance between the wiper and the nozzle plate of a printhead, especially if the printhead is of the kind having raised adhesive beads dispensed near the ends of the nozzle plate.

In one embodiment, two wiper blades are arranged one behind the other where a first wiper blade has a shorter length than the second wiper blade. The shorter blade is sufficient to just extend between two end nozzles on a nozzle plate. The longer blade has a length of approximately the distance between two parallel adhesive beads dispensed at both ends of the nozzle plate perpendicular to the array of nozzles. Any lifting of an end of the longer blade by the raised beads, causing the end of the longer blade to lift above the end nozzles, will not affect the wiping of the end nozzles by the shorter blade.

In another embodiment, two different size wiper blades, arranged one behind the other, have slits formed near the ends of the wiper blades. The slits mechanically decouple those end portions of the wiper blades which ride over the adhesive beads from the remaining portions of the wiper blades to keep the remaining portions of the blades in contact with the nozzle plate.

DETAILED DESCRIPTION OF THE PREFERRED EMBODIMENTS

Figure 1:
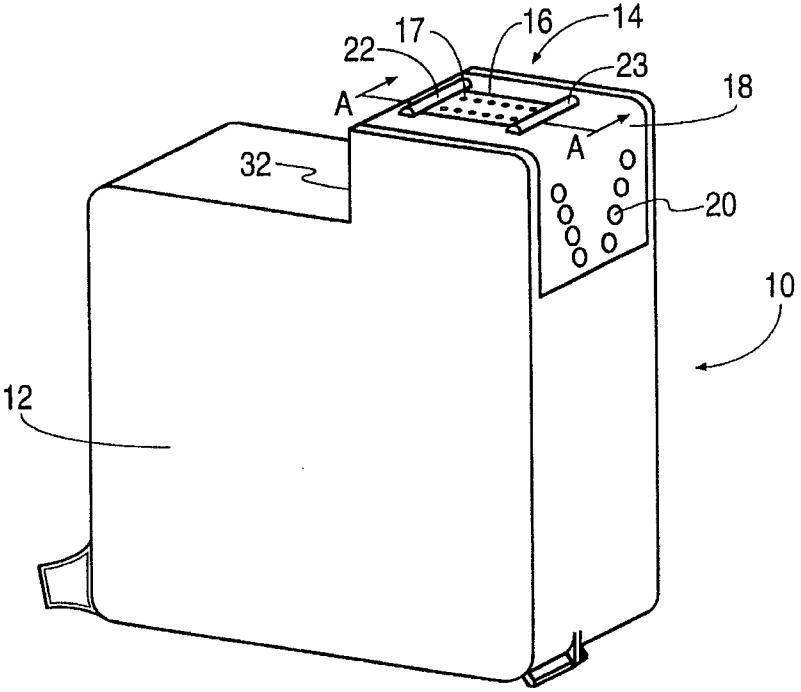
FIG. 1 (PRIOR ART)
FIG. 1 is a perspective view of an inkjet print cartridge which may utilize the present invention.
Figure 2B:
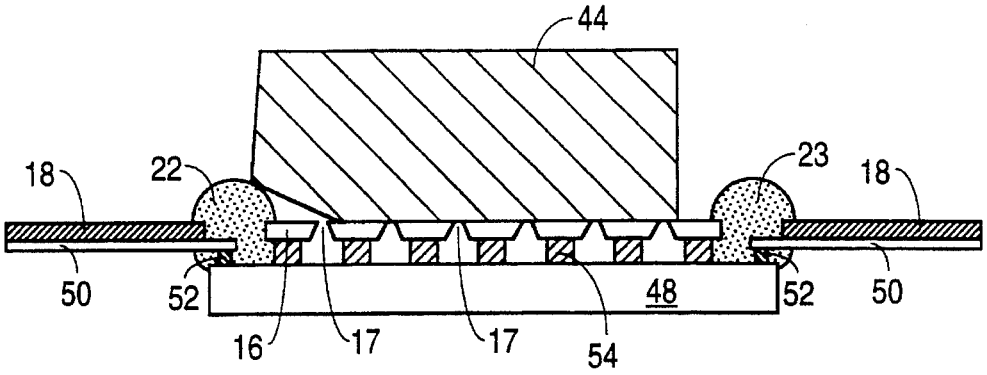
FIG. 2b (PRIOR ART)
FIG. 2*b* is a side view in cross-section along line A—A of FIG. 1 when the print cartridge of FIG. 1 is moved across a wiper in FIG. 2*a*.
Figure 3:
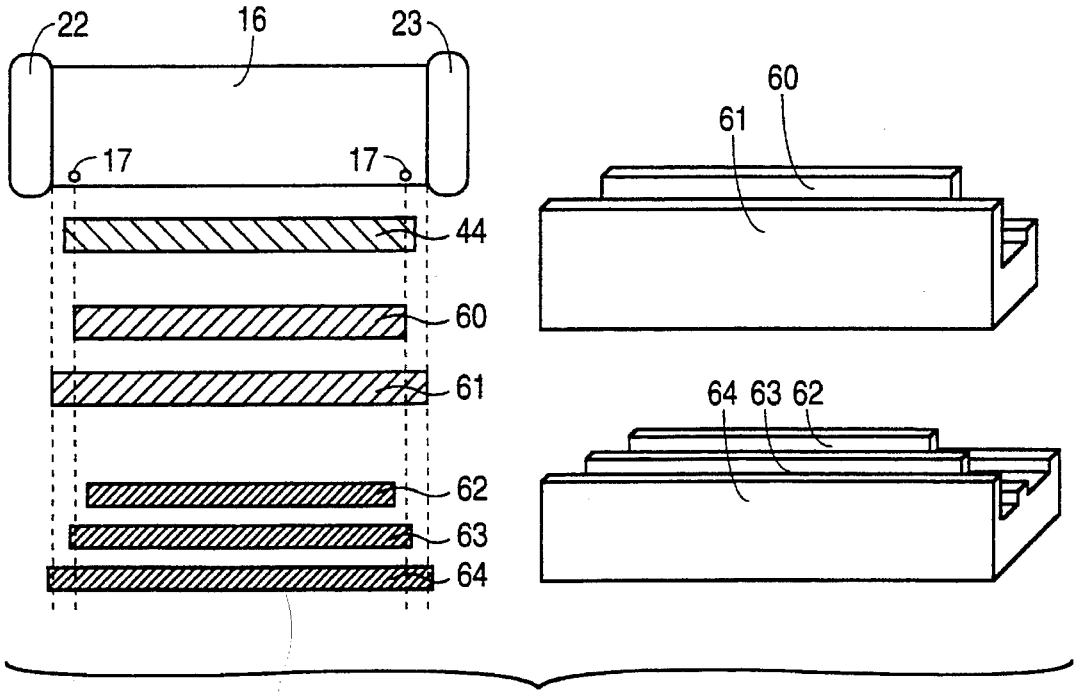
FIG. 3 is a top plan view and a perspective view of two different wiper structures according to the invention.

FIG. 3 illustrates two embodiments of the present invention. A top view of the printhead portion of print cartridge 10 of FIG. 1 is shown, where raised adhesive beads 22 and 23 are dispensed at both ends of nozzle plate 16. Two end nozzles 17 are shown.

The left portion of FIG. 3 shows a top view of a conventional single blade wiper 44, a dual-blade wiper having blades 60 and 61, and a triple-blade wiper having blades 62, 63, and 64. The right portion of FIG. 3 is a perspective view of the double-blade wiper and triple-blade wiper. Wiper blades 60–64 may be formed of rubber, plastic, a composite, or any other suitable material.

For purposes of illustration, it is presumed that the distance between an end nozzle 17 and the raised adhesive beads 22 and 23 is 0.5 mm.

For the conventional single blade wiper 44, the ends of wiper 44 must be aligned so as to be somewhere between the end nozzle 17 and the raised adhesive bead 22 or 23. Assuming the ends of wiper 44 are to be located midway between the end nozzle 17 and the raised adhesive bead 22 or 23, the alignment tolerance for the single blade wiper 44 is ±0.25 mm in either direction. A conventional thickness of wiper 44 is approximately 1 mm.

Using the novel double-blade wiper comprising wipers 60 and 61, the alignment tolerance is ± 0.5 mm due to the different lengths of wiper blades 60 and 61. In the preferred embodiment of the double-blade wiper structure, blades 60 and 61 each have a thickness of approximately 1–1.2 mm, with a gap between them of approximately 1 mm. Assuming a distance between raised beads 22 and 23 of approximately 14 mm, the preferred length of wiper blade 60 is approximately 13 mm, with the ends of wiper blade 60 being aligned with the end nozzles 17. Wiper blade 61 preferably extends between raised beads 22 and 23 and so will be approximately 14 mm long.

If the double-blade wiper structure comprising wiper blades 60 and 61 is misaligned 0.5 mm to the left with respect to nozzle plate 16, wiper blade 60 will not wipe over the right end nozzle 17, but the longer wiper blade 61 will still wipe over the right end nozzle 17. Since the wiper structure is misaligned to the left 0.5 mm, the left end of the longer wiper blade 61 rides over bead 22 and thus is lifted above left nozzle 17. However, left nozzle 17 is being wiped by the shorter wiper blade 60, since wiper blade 60 does not ride over bead 22.

Figure 2A:
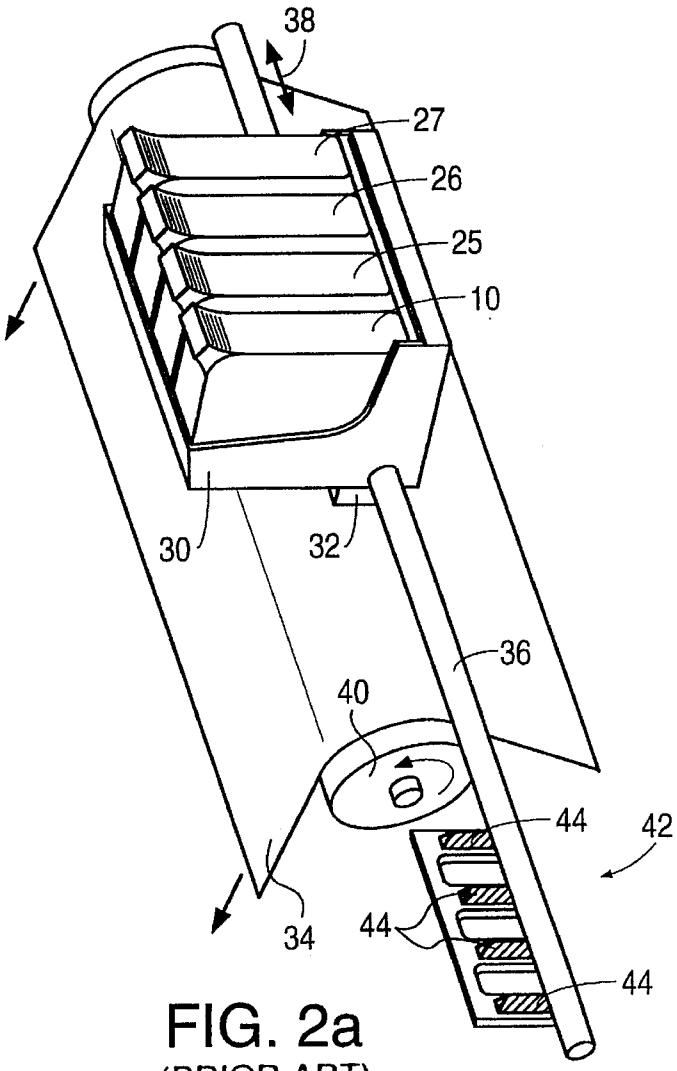
FIG. 2a (PRIOR ART)
FIG. 2*a* illustrates multiple print cartridges being installed in a printer where standard wiper blades are used to wipe the nozzle plates of the print cartridges.

The right side of FIG. 3 shows that wiper blades 60 and 61 are preferably formed as a unitary structure, preferably using a mold, to maintain the proper distance between wiper blades 60 and 61 and to facilitate handling. Blades 60 and 61 may also be individually formed blades which are separated by the proper distance. The double-blade wiper structure comprising wiper blades 60 and 61 may be installed in an inkjet printer in the same manner that the single blade wipers 44 are installed, as shown in FIG. 2*a*.

Additionally, two wiper blades of equal length (e.g., 13.5 mm) which are offset (e.g., by 0.5 mm) from each other may achieve results similar to that of the double-blade structure of FIG. 3.

A triple-blade wiper structure is also shown in FIG. 3 comprising wiper blades 62, 63, and 64. The operation of this triple-blade wiper is similar to the operation of the double-blade wiper previously described but provides an increased alignment tolerance of ±0.75 mm. The preferred thickness of a wiper blade is between 1–1.2 mm; however, since the preferred total width of a wiper structure should be less than about 3 mm, the thickness of each of wiper blades 62, 63, and 64 should be only approximately 0.6 mm, with a gap of 0.6 mm between adjacent wipers.

As shown in FIG. 3, rear wiper blade 64 is about 0.5 mm longer than the distance between adhesive beads 22 and 23. The middle wiper blade 63 is slightly longer than the distance between the two end nozzles 17. The front wiper blade 62 is about 0.5 mm shorter than the distance between the two end nozzles 17. Given the above constraints, the misalignment of the triple-blade wiper structure can be as much as 0.75 mm to the left or right before the wiper structure begins to not completely wipe the end nozzles 17 due to the blades being lifted by either of beads 22 or 23.

A perspective view of the unitary, triple-blade wiper structure is shown on the right side of FIG. 3. In an alternative embodiment, each of blades 62, 63 and 64 may be separately formed.

Figure 4:
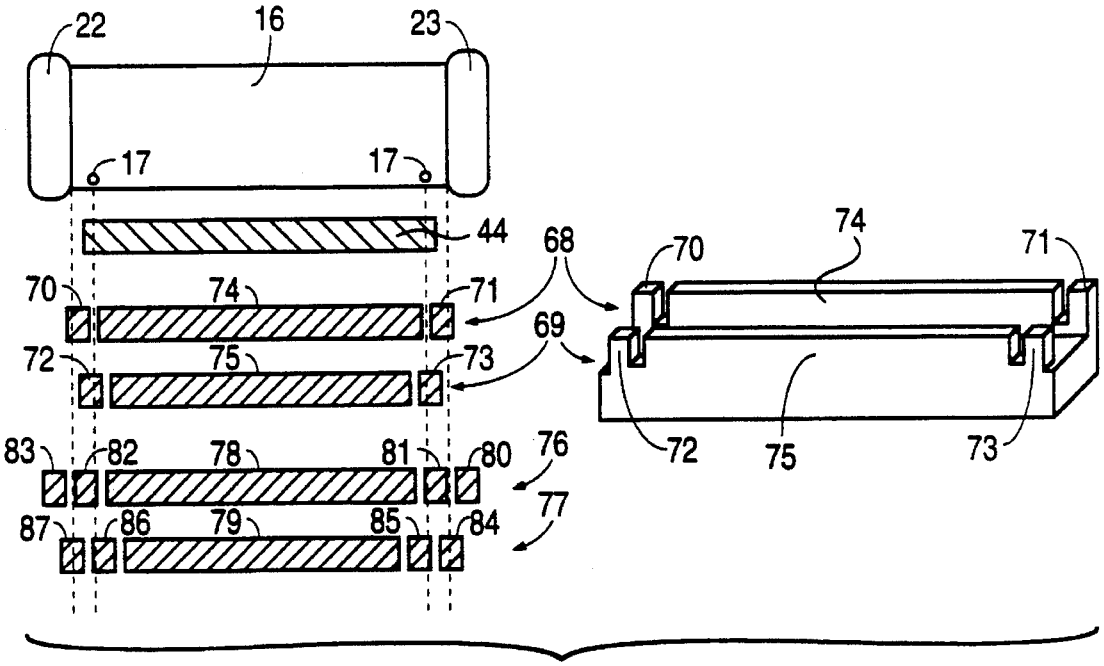
FIG. 4 is a top plan view of two additional wiper structures, along with a perspective view of one of the wiper structures, according to the invention.

Shown in FIG. 4 is a top view of the printhead portion of print cartridge 10 in FIG. 1 along with two different double-blade wiper structures, each utilizing split wiper blades. The double-blade wiper structures in FIG. 4 increase the alignment tolerance over that of the previously-described triple-blade structure, yet may incorporate wiper blades having a preferred thickness of 1–1.2 mm.

A first embodiment of a split, double-blade wiper structure comprises blades 68 and 69. The right side of FIG. 4 is a perspective view of wiper blades 68 and 69 shown formed as a unitary structure of rubber, plastic, a composite, or other suitable material. In another embodiment, blades 68 and 69 may be formed separately. The end split portions 70–73 of blades 68 and 69 are mechanically decoupled from the central portions 74, 75 of blades 68 and 69 by the slits in the blade. When an end split portion of either of blades 68 and 69 rides over a raised bead 22 or 23, the lifting of the end split portion does not affect the wiping of nozzle plate 16 by the central portions 74, 75 of the wiper blades 68 and 69. The end split portions 72, 73 of rear wiper blade 69 are aligned with the gaps in wiper blade 68.

Given that the central portion 75 of rear wiper blade 69 has a length of approximately 12.4 mm and is ideally aligned to have its ends 0.8 mm from each adhesive bead 22 and 23, the wiper blade structure comprising blades 68 and 69 may be misaligned by as much as ±0.8 mm before the central portion 75 of wiper blade 69 is lifted by bead 22 or 23. The total length of the front wiper blade 68 is approximately 15 mm, which is greater than the distance between beads 22 and 23. The length of each end split portion 70–73 is approximately 0.5 mm, and the gap between the split portions is approximately 0.25 mm.

The preferred dimensions of the wiper blades would vary depending on the actual distance between beads 22 and 23 and the distance between an end nozzle 17 and the closest bead 22 or 23.

The preferred embodiment of the invention is shown as the double-blade structure comprising blades 76 and 77. In this structure, shown in detail in FIG. 5, blades 76 and 77 have a total of ten mechanically decoupled wiper portions, comprising relatively long central portions 78, 79 and two split portions 80–87 on both ends of the central portions 78, 79.

The preferred thickness of each wiper blade 76 and 77 is approximately 1–1.2 mm. The preferred length of each end split portion 80–87 is approximately 0.5 mm, and the gap between the end split portions is approximately 0.25 mm. Central portion 78 has a length of approximately 12.5 mm, and central portion 79 has a length of approximately 11.75 mm.

Generally, the gaps separating each of the end split portions from the central blade portion should be made as narrow as possible. However, gaps less than 0.25 mm wide have been shown to be difficult to form due to the constraints on the mold used to form the wiper blades.

Figure 5:
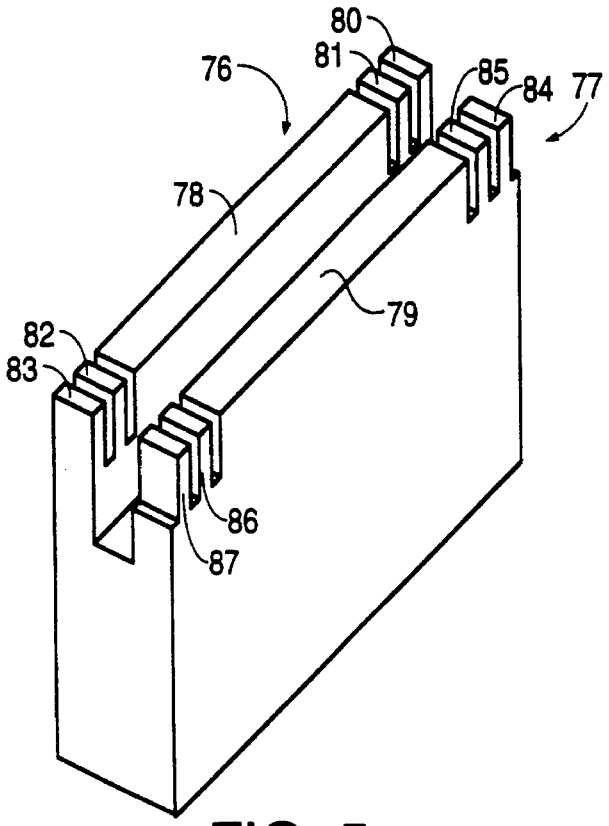
FIG. 5 is a perspective view of the preferred embodiment wiper structure.

The preferred wiper structure of FIG. 5 is preferably formed of rubber, plastic, or a composite as a molded unitary structure. In another embodiment, blades 76 and 77 may be formed separately.

Figure 6A:
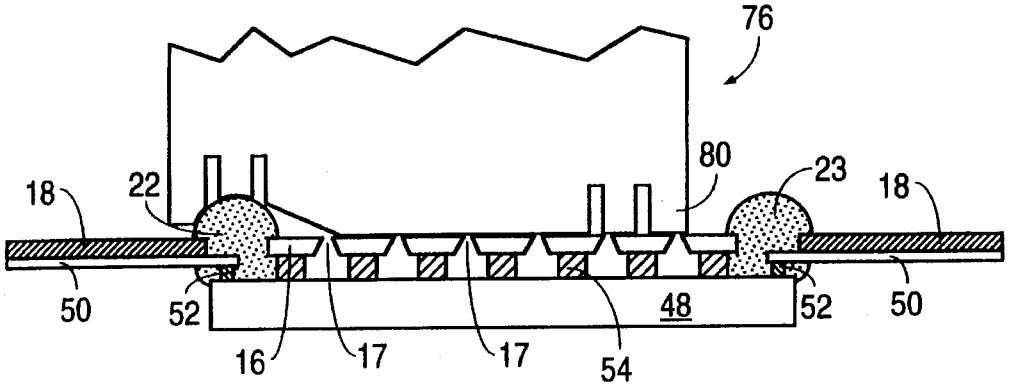
FIG. 6*a* is a side view in cross-section along line A—A in FIG. 1 of the print cartridge nozzle plate being wiped by the first wiper blade of FIG. 5 when the wiper of FIG. 5 is misaligned a maximum amount.

FIG. 6*a* is a side view of the printhead shown in FIG. 1, taken along A—A in FIG. 1, when being shifted across the first wiper blade 76 of FIG. 5 when the wiper structure of FIG. 5 is misaligned to the left 1.125 mm with respect to nozzle plate 16. As seen, the right-most wiper portion 80 still wipes the right end nozzle 17, but the left end nozzle 17 is not being wiped by blade 76.

Figure 6B:
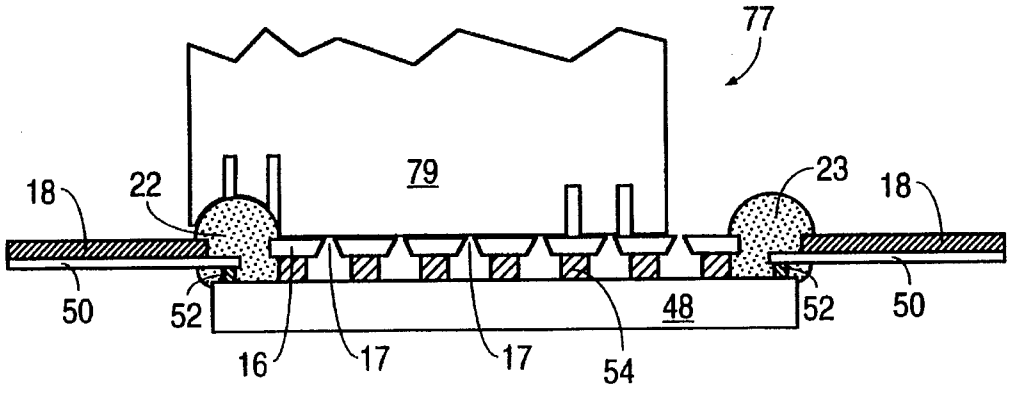
FIG. 6*b* is the same side view as FIG. 6*a* showing the action of the second wiper blade, behind the first wiper blade, wiping the nozzle plate.

FIG. 6*b* illustrates the same cross-section of the print cartridge of FIG. 1 when the second wiper blade 77 wipes nozzle plate 16. As seen, the left end nozzle 17 is being properly wiped by the central portion 79 of wiper blade 77.

Figure 7:
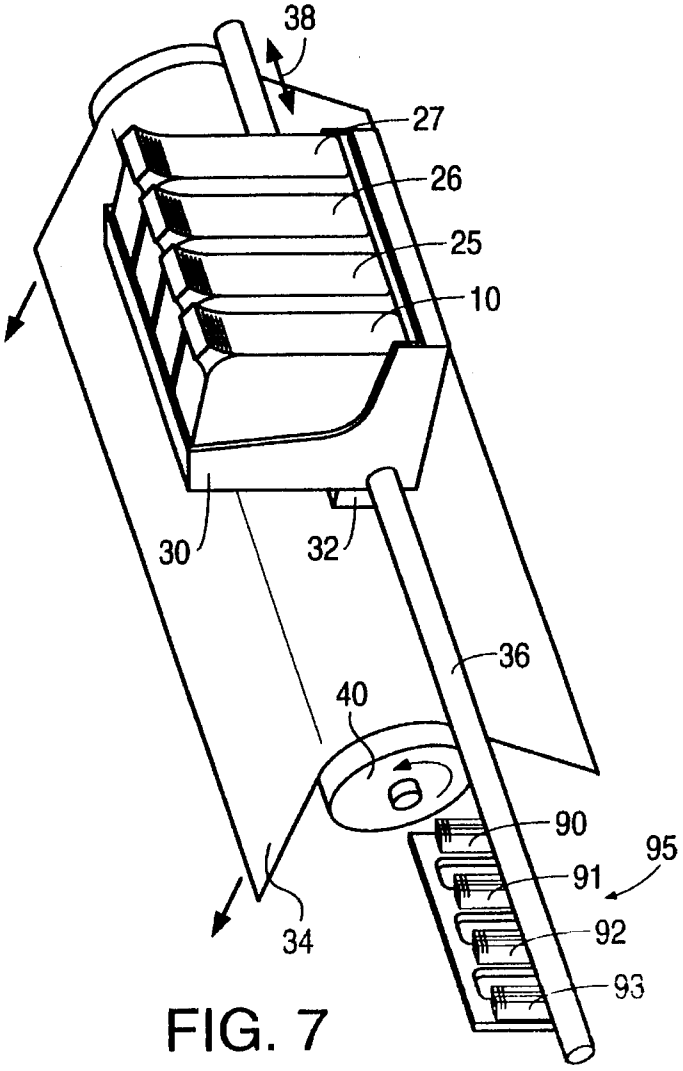
FIG. 7 illustrates the printer structure of FIG. 2*a* but with the preferred embodiment wipers being substituted for the conventional single blade wipers.

FIG. 7 illustrates the preferred embodiment wiper structure of FIG. 5, comprising wiper blades 76 and 77, installed in an inkjet printer. Since, in the embodiment of FIG. 7, four print cartridges are used, four identical wiper structures 90, 91, 92, and 93 are provided which are each identical to the wiper structure shown in FIG. 5. The four wiping structures 90–93 are raised in position to contact and wipe clean the nozzle plates on the print cartridges 10, 25, 26, and 27 when carriage 30 is moved into the service station area 95. The movement of carriage 30 may trigger a lever, cam, or other mechanical or electrical means to raise wiper structures 90–93 into their wiping positions. The mechanism used to move carriage 30 into position in service station 95 and the mechanism to move wiper structures 90–93 into position may include those mechanisms described in the patents and applications identified in the Cross-Reference to Related Applications.

The above-described wiper structure embodiments may be modified depending upon the desired application and alignment tolerance. For example, additional notches may be placed in longer wiper blades to mechanically decouple those split portions of the wiper blades which may ride over the adhesive beads 22 and 23. In this manner, virtually any alignment tolerance can be achieved by providing longer wiper blades with additional end split portions.

Although a specific embodiment of a service station 95 has been shown and described with respect to FIG. 7, other means for moving wiper blades to be in contact with a nozzle plate on a print cartridge may be used. One alternative means would be to provide the wiper blade structure on a rotating cylinder so that when carriage 30 moves past the rotating cylinder, multiple wipes may be made across each nozzle plate.

While particular embodiments of the present invention have been shown and described, it will be obvious to those skilled in the art that changes and modifications may be made without departing from this invention in its broader aspects and, therefore, the appended claims are to encompass within their scope all such changes and modifications a fall within the true scope and spirit of this invention.

What is claimed is:

1. An inkjet printer comprising:

a printhead including a nozzle member having nozzles formed in a planar nozzle member surface and between two raised insulator portions disposed near opposite ends of said nozzle member surface for encapsulating conductors bonded to a substrate affixed to an underside of said nozzle member, said two raised insulator portions being substantially perpendicular to one or more linear arrays of nozzles formed in said nozzle member surface;

a carriage means for moving said printhead across a recording medium in a direction parallel to said two raised insulator portions; and a wiper positioned in said inkjet printer so as to wipe said nozzle member surface for cleaning said nozzle member surface, said wiper having a first wiper blade and a second wiper blade arranged in parallel, one behind the other, with a space therebetween, where said first wiper blade wipes a first portion of said nozzle member surface and said second wiper blade wipes at least part of said first portion of said nozzle member surface and a second portion of said nozzle member surface not included in said first portion, and together said first and said second wiper blade wipe each of said nozzles formed in said nozzle member surface;

wherein said first wiper blade has a first central portion between two ends of said first wiper blade and at least one split portion at each of said two ends of said first wiper blade, said at least one split portion being separated from said first central portion and from any adjacent split portion by a gap having a first width, and wherein said second wiper blade has a second central portion between two ends of said second wiper blade and at least one split portion at each of said two ends of said second wiper blade, said at least one split portion of said second wiper blade being aligned with an associated gap formed in said first wiper blade.

2. The printer of claim 1 wherein said first central portion of said first wiper blade has a length approximately equal to a separation between two end nozzles located at opposite ends of said nozzle member surface, and said second wiper blade has a split portion aligned with each end of said first central portion.

3. The printer of claim 1 wherein said first wiper blade has at least two split portions at each of said two ends of said first wiper blade, and said second wiper blade has at least two split portions at each of said two ends of said second wiper blade.

4. The printer of claim 1 wherein said second wiper blade is shorter in length than said first wiper blade.

5. The printer of claim 1 wherein said first wiper blade and said second wiper blade have lengths greater than a separation between two end nozzles located at opposite ends of said nozzle member surface.

6. The printer of claim 1 wherein said at least one split portion of said first wiper blade rides over one of said two raised insulator portions when said printhead is in contact with said wiper.

7. A method for wiping an inkjet printhead in an inkjet printer, said printhead including a nozzle member having nozzles formed in a planar nozzle member surface and between two raised insulator portions disposed near opposite ends of said nozzle member surface for encapsulating conductors bonded to a substrate affixed to an underside of said nozzle member, said two raised insulator portions being substantially perpendicular to one or more linear arrays of nozzles formed in said nozzle member surface, said method comprising the steps of:

moving a carriage, containing said printhead, in a direction parallel to said two raised insulator portions, to be in contact with a wiper;

wiping said nozzle member surface with a first wiper blade to wipe a first portion of said nozzle member surface;

wiping said nozzle member surface with a second wiper blade to wipe a second portion of said nozzle member surface, where said first portion and said second portion are different from one another; and said wiper being aligned with respect to said nozzle member surface so that said first wiper blade and said second wiper blade together wipe each of said nozzles formed in said nozzle member surface despite an end portion of said first wiper blade or said second wiper blade riding over one of said two raised insulator portions when said wiper wipes said nozzle member surface;

wherein said first wiper blade has a first central portion between two ends of said first wiper blade and at least one split portion at each of said two ends of said first wiper blade, said at least one split portion being separated from said first central portion and from an adjacent split portion by a gap having a first width, and wherein said second wiper blade has second central portion between two ends of said second wiper blade and at least one split portion at each of said two ends of said second wiper blade, said at least one split portion of said second wiper blade being aligned with an associated gap formed in said first wiper blade.

* * * * *